US008555855B2

(12) United States Patent
Tsutsumi

(10) Patent No.: US 8,555,855 B2
(45) Date of Patent: Oct. 15, 2013

(54) THROTTLE VALVE CONTROL SYSTEM FOR AN INTERNAL COMBUSTION ENGINE, ENGINE INCORPORATING SAME, AND VEHICLE INCORPORATING SAME

(75) Inventor: Tomohiro Tsutsumi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 1066 days.

(21) Appl. No.: 12/584,879

(22) Filed: Sep. 14, 2009

(65) Prior Publication Data

US 2010/0077991 A1 Apr. 1, 2010

(30) Foreign Application Priority Data

Sep. 30, 2008 (JP) ..... 2008-255455

(51) Int. Cl.
*F02D 9/10* (2006.01)

(52) U.S. Cl.
USPC ..... 123/336

(58) Field of Classification Search
USPC ..... 123/336, 337, 399, 442, 401, 402, 434, 123/468, 469, 470
See application file for complete search history.

(56) References Cited

U.S. PATENT DOCUMENTS

| | | | | |
|---|---|---|---|---|
| 5,522,362 | A * | 6/1996 | Motose | 123/339.13 |
| 5,577,477 | A * | 11/1996 | Katoh | 123/456 |
| 7,490,589 | B2 * | 2/2009 | Itagaki | 123/396 |
| 7,987,834 | B2 * | 8/2011 | Itagaki | 123/397 |
| 2006/0225708 | A1 * | 10/2006 | Taguchi et al. | 123/468 |

FOREIGN PATENT DOCUMENTS

| | | |
|---|---|---|
| JP | 2002-256895 A | 9/2002 |
| JP | 2002-256900 | 9/2002 |
| JP | 2008-267313 A | 11/2008 |

* cited by examiner

*Primary Examiner* — Stephen K Cronin
*Assistant Examiner* — Sizo Vilakazi
(74) *Attorney, Agent, or Firm* — Carrier Blackman & Associates, P.C.; William D. Blackman; Joseph P. Carrier

(57) ABSTRACT

A throttle valve control system for an internal combustion engine includes plural throttle bodies with respective intake passages formed therethrough. Each of the respective throttle bodies includes a throttle valve shaft and a throttle valve, the throttle valves are operated by an actuator via the throttle valve shafts. The throttle bodies are each provided with plural fuel injection valves, and fuel lines which connect adjacent fuel injection valves together are arrayed in parallel with a direction of the throttle valve shafts, and are arranged between the throttle bodies and the actuator.

20 Claims, 14 Drawing Sheets

THROTTLE VALVE CONTROL SYSTEM FOR AN INTERNAL COMBUSTION ENGINE, ENGINE INCORPORATING SAME, AND VEHICLE INCORPORATING SAME

CROSS-REFERENCE TO RELATED APPLICATIONS

The present invention claims priority under 35 USC 119 based on Japanese patent application No. 2008-255455, filed on Sep. 30, 2008. The entire subject matter of this priority document, including specification claims and drawings thereof, is incorporated by reference herein.

BACKGROUND OF THE INVENTION

1. Field of the Invention

This invention relates to a throttle valve control system for a four-cycle internal combustion engine, and to an engine and a vehicle incorporating the same. More particularly, the present invention relates a throttle valve control system for an engine in which throttle valves are operated by an actuator, and in which plural fuel injection valves and fuel lines are arranged between throttle bodies and the actuator. The present invention also relates to an engine and a to a vehicle incorporating the described throttle valve control system.

2. Description of the Background Art

There are several known throttle valve control systems for four-cycle internal combustion engines. An example of a throttle valve control system for a four-cycle internal combustion engine is disclosed in the Japanese Laid-open Patent document No. 2002-256900.

In a four-cycle internal combustion engine disclosed in Japanese Laid-open Patent document No. 2002-256900, an actuator for driving plural throttle valves is disposed on a side of plural fuel injection valves, and fuel lines for supplying fuel to the plural fuel injection valves are arranged at locations remote from the fuel injection valves to avoid interference with the actuator.

In the four-cycle internal combustion engine described in Japanese Laid-open Patent document No. 2002-256900, the fuel lines are arranged at the locations remote from the fuel injection valves. Therefore, the arrangement of the fuel injection valves is restricted by the fuel lines, and in some instances, is also affected considerably by the location and position of the actuator, so that the freedom of design layout in placement of the fuel injection valves is limited, leading to a potential problem that the performance of the engine may be affected.

If priority is given to the arrangement of the fuel injection valves at appropriate locations to avoid the above-mentioned problem, the fuel lines have to be extended and arranged detouring considerably, thereby raising another problem that the fuel lines become longer.

The present invention has been made to overcome such drawbacks of the existing throttle valve control systems for internal combustion engines. Accordingly, it is one of the objects of the present invention to provide a throttle valve control system for an internal combustion engine, which is free of such problems as those described above.

SUMMARY OF THE INVENTION

In order to achieve the above objects, the present invention according to a first aspect thereof is characterized in that in a throttle valve control system for an internal combustion engine is configured such that plural throttle bodies with respective intake passages formed therethrough are arrayed along throttle valve shafts and throttle valves are operated (i.e., open/close driven) by an output from an actuator via the throttle valve shafts. The throttle bodies are each provided with plural fuel injection valves, and fuel lines which connect their corresponding fuel injection valves together and are arrayed in parallel with a direction of the throttle valve shafts between the throttle bodies and the actuator.

The present invention according to a second aspect thereof is characterized in that the actuator includes a motor, a reduction gear, an output shaft and an actuator case. Rotational axes of the motor, the reduction gear and the output shaft are arranged in parallel with each other, and along a plane such that the actuator is constructed in a substantially flattened form.

The actuator is arranged such that a plane, which extends through the plural rotational axes in the actuator, is oriented in a direction inclined relative to the intake passages, and the fuel lines are arranged at locations in a wide space between the throttle bodies and the actuator case.

The present invention according to a third aspect thereof is characterized in that the fuel injection valves are oriented substantially in parallel with the plane which extends through the plural rotational axes in the actuator.

The present invention according to a fourth aspect thereof is characterized in that the fuel injection valves are arranged adjacent to a portion of the actuator case, the portion being close to the throttle bodies. The actuator is inclined relative to the throttle bodies.

The present invention according to a fifth aspect thereof is characterized in that the fuel lines are arranged in a vicinity of a plane extending through intake upstream ends of the throttle bodies and intersecting at right angles with a direction of intake through the throttle bodies.

The present invention according to a sixth aspect thereof is characterized in that the fuel injection valves are provided with couplers. The couplers are operable to supply electric inputs to the fuel injection valves, and are arranged along an intermediate plane between the motor and the output shaft of the actuator.

EFFECTS OF THE INVENTION

According to the first aspect of the present invention, a throttle valve control system for an internal combustion engine is arranged such that plural throttle bodies with respective intake passages formed therethrough are arrayed along throttle valve shafts and throttle valves are operated (i.e., opened/closed) by an output from an actuator via the throttle valve shafts. The throttle bodies are each provided with plural fuel injection valves, and fuel lines which connect their corresponding fuel injection valves together are arrayed in parallel with a direction of the throttle valve shafts, and are arranged between the throttle bodies and the actuator.

Therefore, the arrangement of the fuel lines is not restricted by the existence of the actuator, and the fuel injection valves can be arranged at appropriate positions. Accordingly, it is possible to decrease a reduction in the performance of the internal combustion engine, and also to avoid longer paths for the fuel lines so that the fuel lines can be shortened.

According to the second aspect of the present invention, the actuator includes the motor, the reduction gear, the output shaft and the actuator case. The rotational axes of the motor, the reduction gear and the output shaft are arranged in parallel with each other and along a plane such that the actuator is constructed in a substantially flattened form and shape. The actuator is arranged such that a plane, which extends through the plural rotational axes of various components of the actuator (e.g., a motor, a reduction gear, an output shaft), is oriented in a direction inclined relative to the intake passages, and the fuel lines are arranged in a wide space between the throttle bodies and the actuator case.

Therefore, the throttle bodies, the actuator case, the fuel injection valves and the fuel lines can be assembled together into a compact structure, thereby making it possible to achieve a reduction in an overall size of the internal combustion engine.

According to the third aspect of the present invention, the fuel injection valves are oriented substantially in parallel with the plane which extends through the plural rotational axes in the actuator. Therefore, it is possible to achieve a reduction in size of the throttle valve control system including the actuator, and also a reduction in size of the fuel supply system.

According to the fourth aspect of the present invention, the fuel injection valves are arranged adjacent to a portion of the actuator case, the portion being close to the throttle bodies, in the actuator inclined relative to the throttle bodies.

Therefore, it is possible to reduce interference between the fuel injection valves and the actuator so that the fuel injection valves can be assembled in the throttle valve control system without taking much space.

According to the fifth aspect of the present invention, the fuel lines are arranged in a vicinity of a plane extending through intake upstream ends of the throttle bodies and intersecting at right angles with a direction of intake through the throttle bodies.

Therefore, the fuel lines can be arranged at low positions in a wide space between the throttle bodies and the actuator, thereby making it possible to reduce the dimension in the direction of the height of the throttle valve control system.

According to the sixth aspect of the present invention, the fuel injection valves are provided with couplers, which are operable to supply electric inputs to the fuel injection valves, and the couplers are arranged oriented toward between the motor and the output shaft in the actuator.

Therefore, wiring can be efficiently and readily arranged by making harnesses, which are connected to the couplers, and extend between the motor and the output shaft without bypassing the actuator.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

An embodiment of the present invention will now be described, with reference to the drawings. Throughout this description, relative terms like "up," "down," "upper", "lower", "above", "below", "front", "rear", and the like are used in reference to a vantage point of an operator of the vehicle, seated on the driver's seat and facing forward. It should be understood that these terms are used for purposes of illustration, and are not intended to limit the invention.

Figure 1:
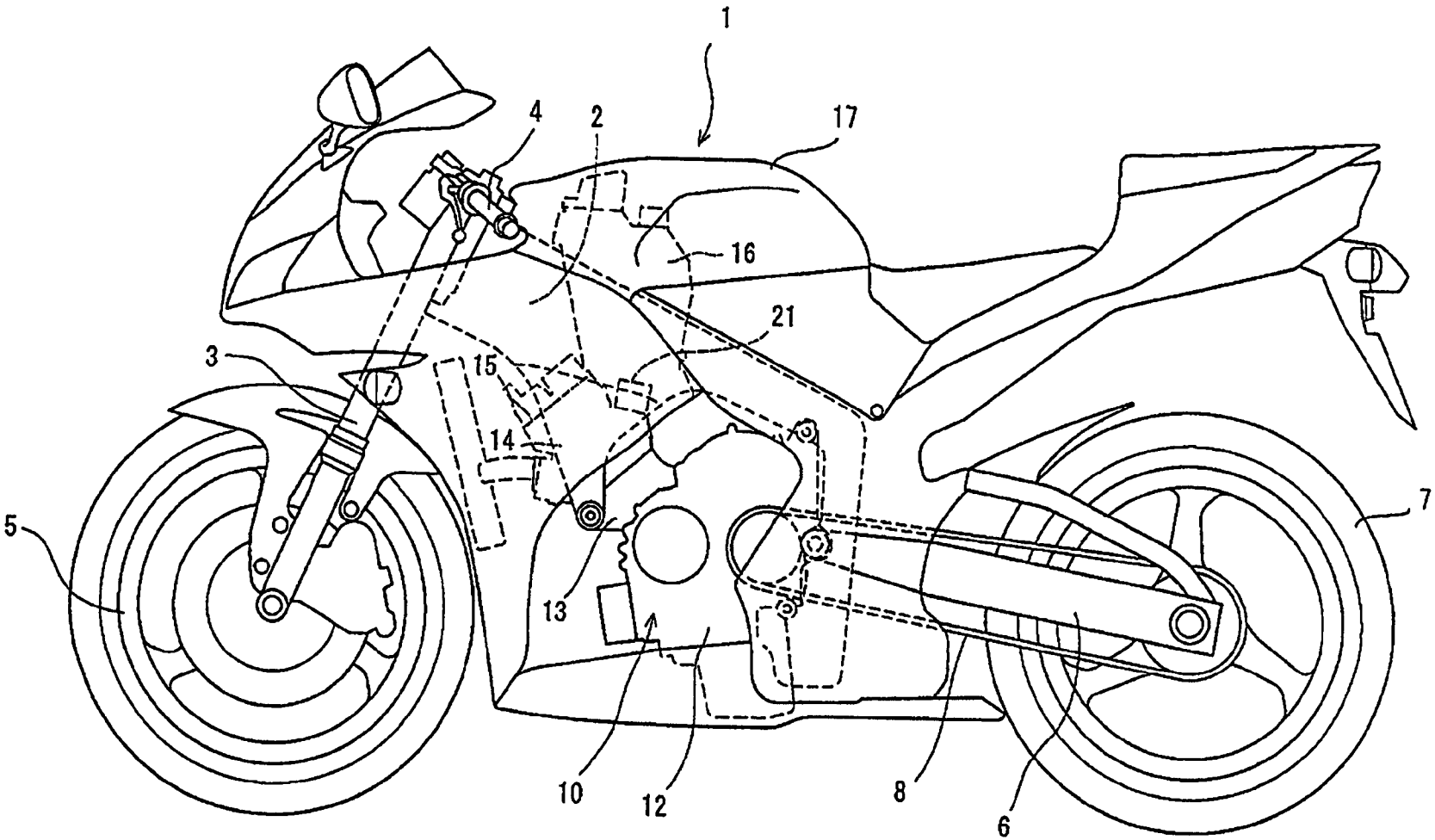
FIG. 1 is a side view of a motorcycle having an internal combustion engine equipped with a throttle valve control system according to the present invention mounted thereon.

As shown in FIG. 1, an inline four-cylinder internal combustion engine 10 is mounted on the motorcycle 1. The engine 10 is equipped with a throttle valve control system 11 according to the present invention. The engine 10 includes four cylinders arrayed in a lateral direction of a motorcycle body, transverse to the longitudinal axis of the motorcycle 1. The engine 10 is an over-head-cam (OHC) type engine.

A front fork 3 is arranged on a front end of a main frame 2 of the motorcycle 1. The front fork 3 is operable to selectively turn leftward or rightward for steering the motorcycle 1. A steering handle 4 is integrally secured to an upper end portion of the front fork 3. A front wheel 5 is rotatably supported on a lower portion of the front fork 3. A rear wheel 7 is rotatably supported on a rear end of a rear fork 6 arranged pivotally up and down on a rear portion of the main frame 2. The rear wheel 7 is rotationally driven by power from the OHC internal combustion engine 10 via a chain transmission system 8.

In the inline four-cylinder OHC internal combustion engine 10, a cylinder block 13 is integrally connected to an upper portion of a crankcase 12. A cylinder head 14 is integrally connected to an upper portion of the cylinder block 13. A head cover 15 is attached to an upper portion of the cylinder head 14. The cylinder block 13 and cylinder head 14 are inclined obliquely upward and forward of the motorcycle 1. An air cleaner housing 16 is arranged above the crankcase 12 and cylinder block 13. The air cleaner housing 16 opens on a side thereof facing forwardly. A filter 19 is disposed in a forward space of the air cleaner housing 16.

Figure 2:
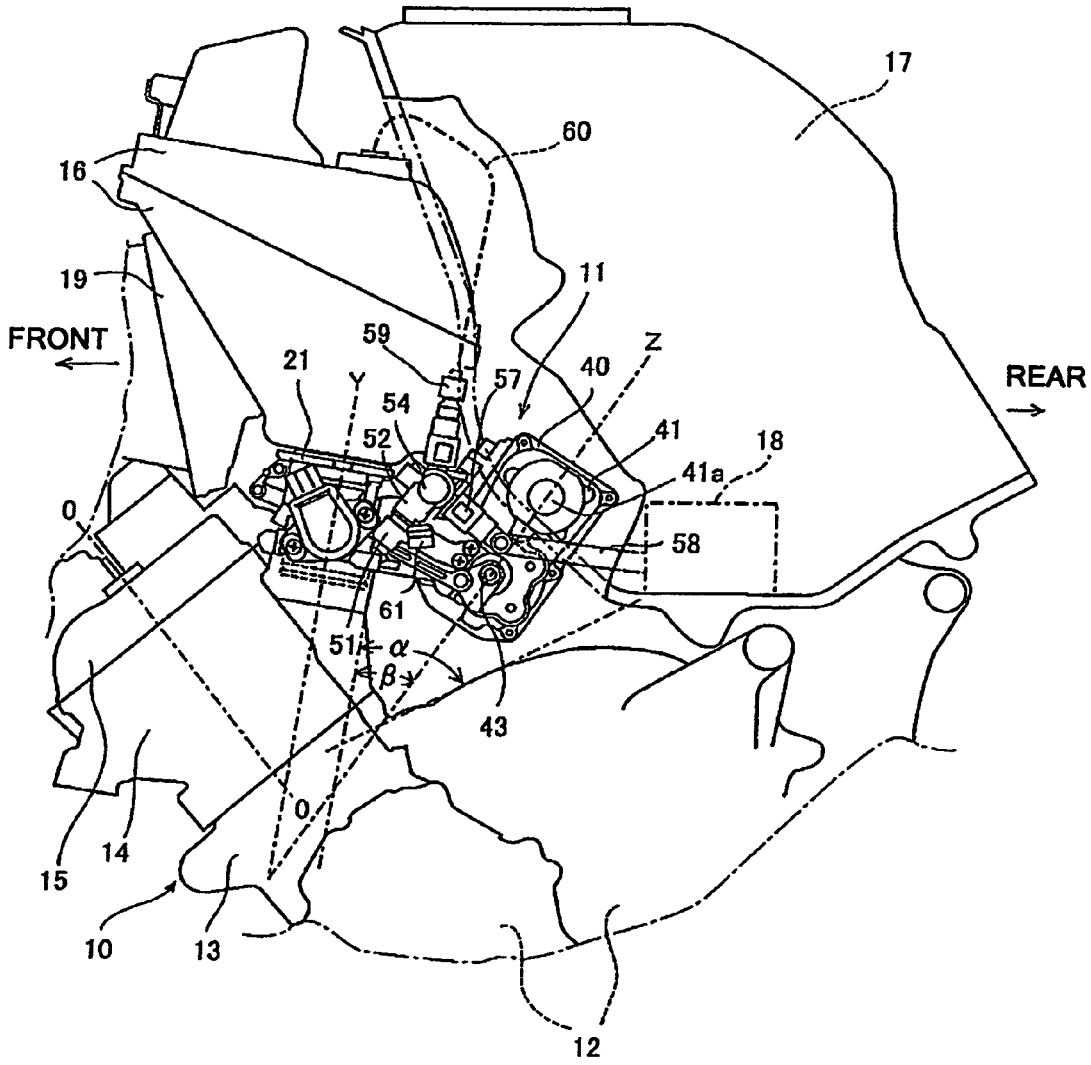
FIG. 2 is an enlarged fragmentary view of FIG. 1.

As shown in FIG. 2, on a bottom wall of the air cleaner housing 16, located in back of the filter 19, a plurality of throttle bodies, i.e., two throttle bodies, including a first throttle body 20 (not shown in FIG. 2) and second throttle body 21 are arranged side by side in a lateral direction (a vehicle width direction) of the motorcycle body.

Figure 3:
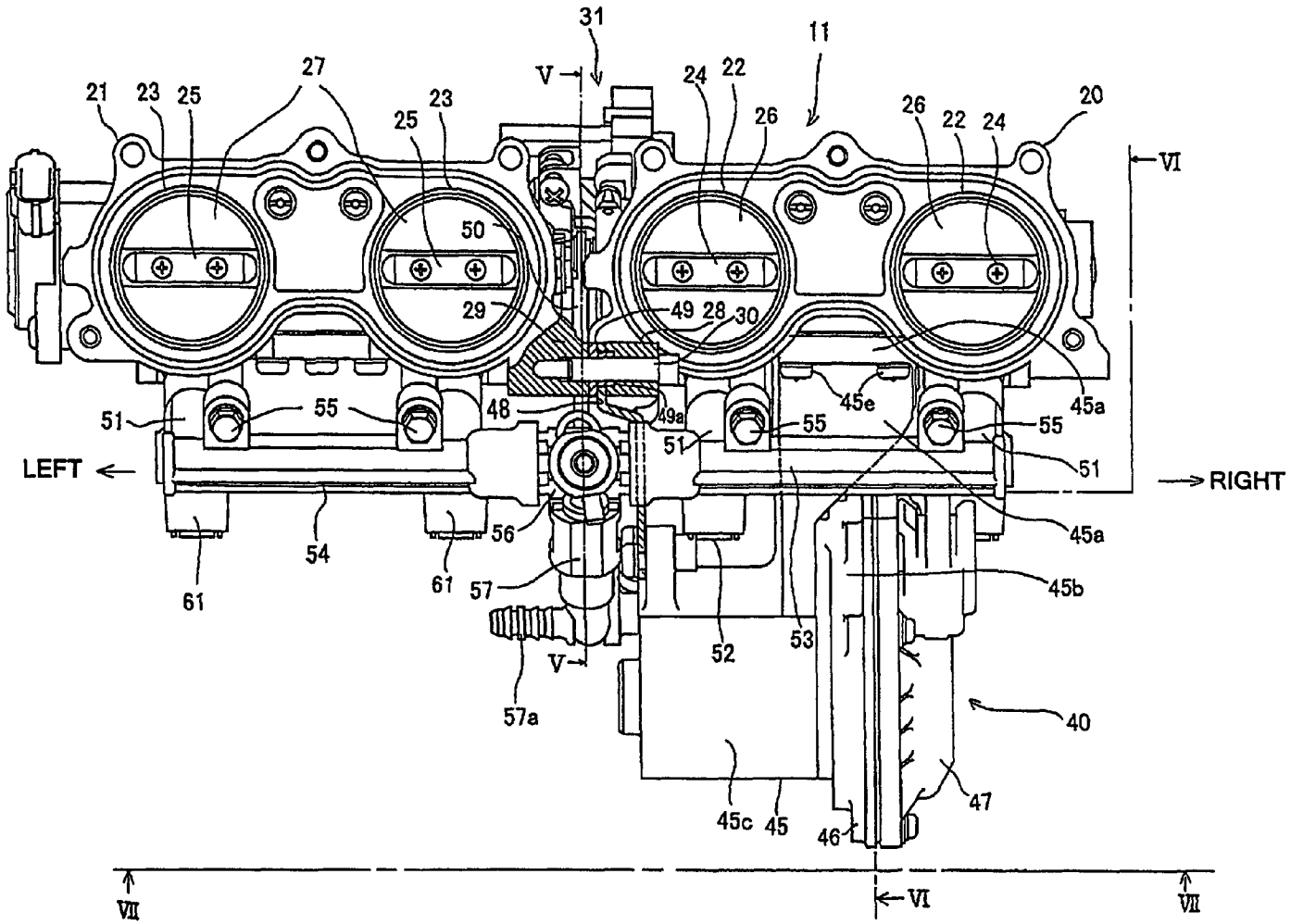
FIG. 3 is a top plan view of the throttle valve control system.

As shown in FIG. 3, a plurality of intake passages, i.e., four in total, including two first intake passages 22, and two second intake passages 23 are formed side by side in the lateral direction of the motorcycle body through the first throttle body 20 on the right side and the second throttle body 21 on the left side, respectively. The first intake passages 22 and second intake passages 23 are arranged such that upper end portions thereof are open to a rearward space of the air cleaner housing 16.

Further, lower end portions of the first intake passages 22 and second intake passages 23 are integrally fitted to a rear portion of the cylinder head 14 such that the first and second intake passages 22, 23 are inclined rearward at approximately 45 degrees relative to a cylinder centerline 0-0 (see FIG. 2) of the cylinder block 13. The four air passages, i.e., the first air passages 22 and second air passages 23 at the lower ends thereof are communicated with combustion chambers (not shown) of the four cylinders in the cylinder block 13, respectively, using intake conduits connected to the respective cylinders through the cylinder head 14.

It may be noted that the intake conduits located in back of the cylinder head 14 are provided with intake valves (not shown), and exhaust conduits (not shown) located forward of the cylinder block 13 are provided with exhaust valves (not shown).

As shown in FIG. 3, a first throttle valve shaft 24 extends through the first throttle body 20 in the lateral direction of the motorcycle body and passes through centers of the two first intake passages 22 in the first throttle body 20. The first throttle valve shaft 24 is rotatably supported on the first throttle body 20. In the two first intake passages 22, two first throttle valves 26 are integrally attached to the first throttle valve shaft 24.

Similarly, a second throttle valve shaft 25 extends through the second throttle body 21 and is rotatably supported on the second throttle body 21. In the second intake passages 23, two second throttle valves 27 are integrally attached to the second throttle valve shaft 25.

First connecting boss portions 28 are formed on front and rear portions of a left end of the first throttle body 20 on the right side. The first connecting boss portions 28 are formed protruding leftward. Second connecting boss portions 29 are formed on front and rear portions of a right end of the second throttle body 21 on the left side. The second connecting boss portions 29 are formed protruding rightward.

In a positional relationship that the first throttle valve shaft 24 and the second throttle valve shaft 25 are positioned on and along a straight line in the lateral direction of the motorcycle body. A plurality of bolts 30 which extend from the right side to the left side through the first connecting boss portions 28 of the first throttle body 20 on the right side are brought into threaded engagement with the second connecting boss portions 29 of the second throttle body 21 on the left side so that the first throttle body 20 and the second throttle body 21 are integrally connected to each other (in FIG. 3, only the rear first connecting boss portions 28, 29 are shown in partial cross-section although the front first connecting boss portions 28, 29 are also constructed likewise).

The throttle valve control system 11 includes a synchronization mechanism 31 and an actuator 40. The synchronization mechanism 31 connects the horizontally-paired first and second throttle valve shafts 24, 25 with each other. The actuator 40 is operable to apply valve-opening force to the first throttle valve shaft 24.

Figure 5:
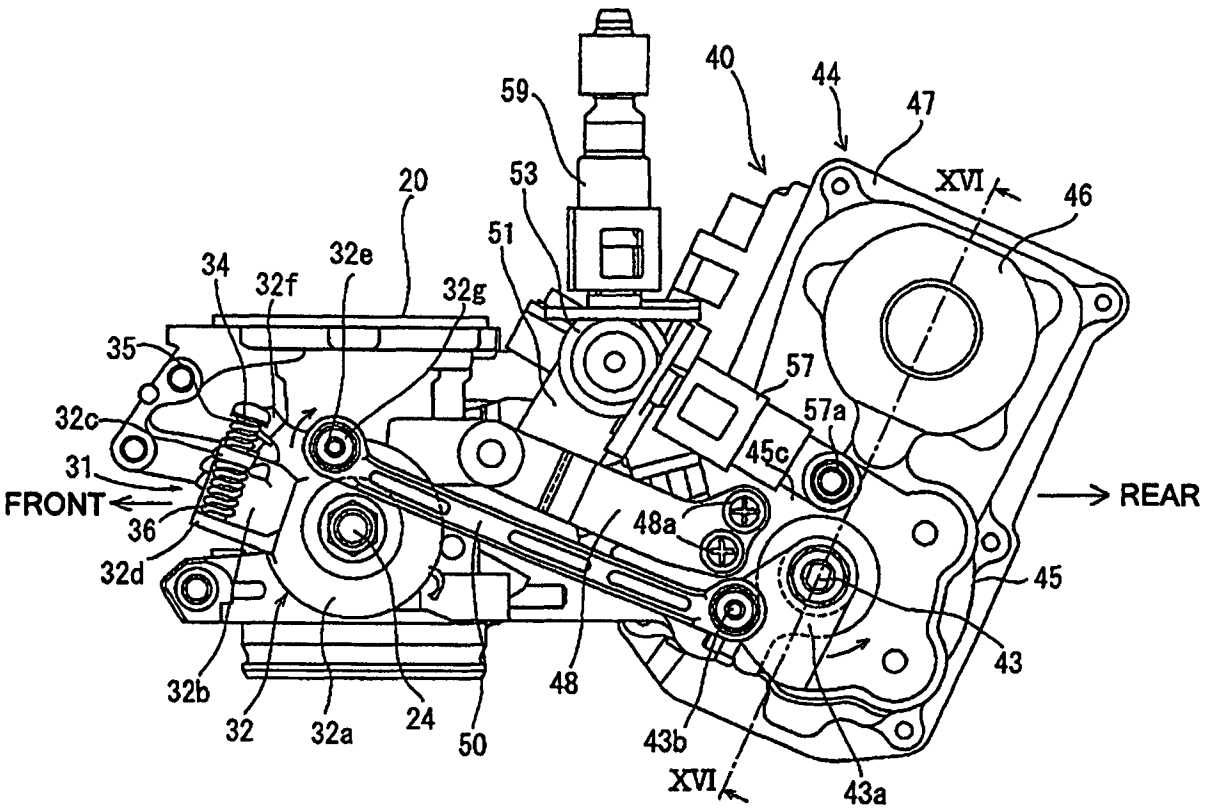
FIG. 5 is a detail view taken in the direction of arrows V-V of FIG. 3.
Figure 8:
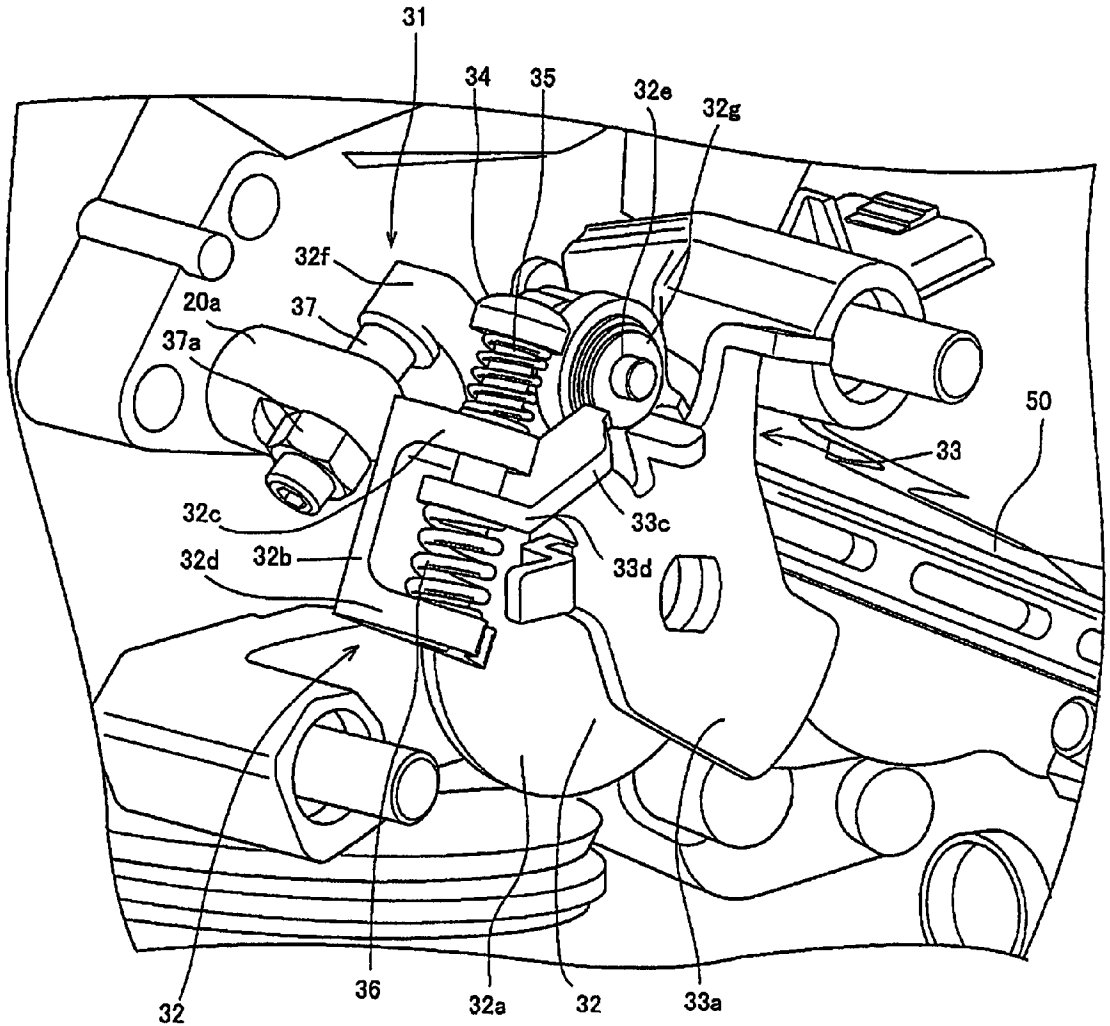
FIG. 8 is a fragmentary perspective view of a synchronization mechanism as seen from the left front of the motorcycle body to the right rear of the motorcycle body.

As shown in FIGS. 3 and 8, the left end of the first throttle valve shaft 24 on the right side and the right end of the second throttle valve shaft 25 on the left side are connected to each other via the synchronization mechanism 31. The synchronization mechanism 31 includes a first lever 32, a second lever 33, an adjustment screw 34, a screw-fixing coil spring 35, a cushion coil spring 36, and a stopper 37. The first lever 32 is fitted on a left end portion of the first throttle valve shaft 24 on the right side. As shown in FIGS. 5 and 8, the second lever 33 is fitted on a right end of the second throttle valve shaft 25 on the left side.

As shown in FIG. 8, the adjustment screw 34 is threadably secured to an upper flange portion 32*c* of the first lever 32. The screw-fixing coil spring 35 prevents the adjustment screw 34 from becoming loose as a result of its turning relative to the first lever 32. The cushion coil spring 36 is secured on an upper wall of a lower flange portion 32*d* of the first lever 32. The stopper 37 extends through a stud 20*a*, which protrudes leftward from a rear portion of the first throttle body 20 on the right side, and is secured to the stud 20*a* by a nut 37*a*.

As shown in FIG. 5, and FIGS. 8 through 12, in the first lever 32, the upper flange portion 32*c* and lower flange portion 32*d* are arranged extending leftward of the motorcycle body from an upper and lower portion of a front extension 32*b* of a disk-shaped base member 32*a*. A pin 32*e* is arranged extending leftward of the motorcycle body from an upper portion of the disk-shaped base member 32*a*.

Figure 9:
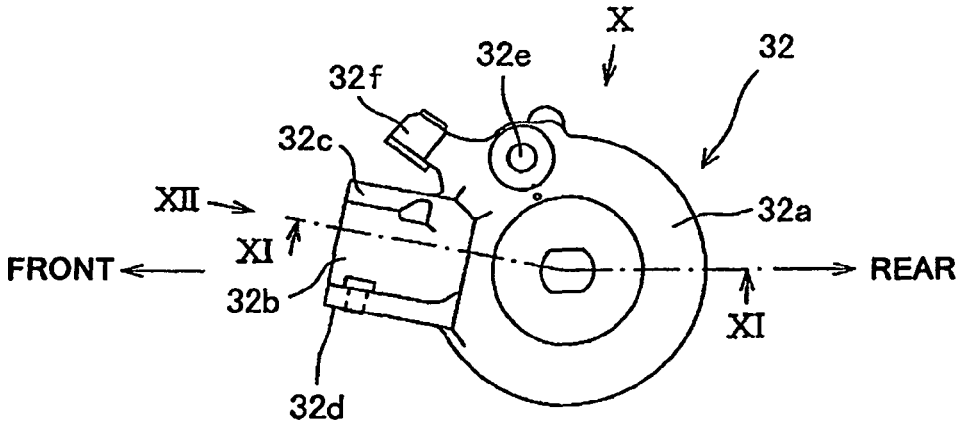
FIG. 9 is a left side view of a first lever.
Figure 10:
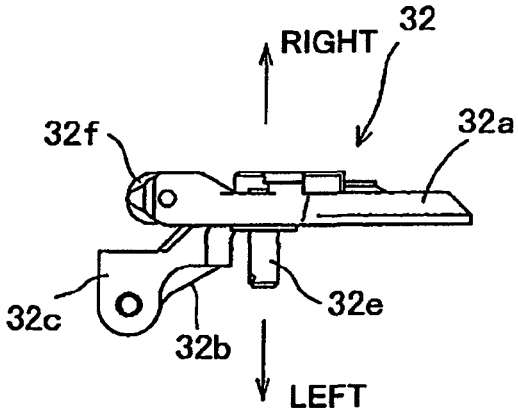
FIG. 10 is a plan view of the first lever.
Figure 11:
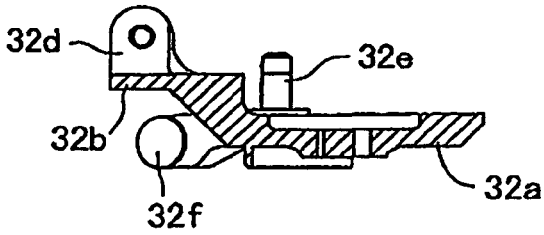
FIG. 11 is a detail view taken in the direction of arrows XI-XI of FIG. 9.
Figure 12:
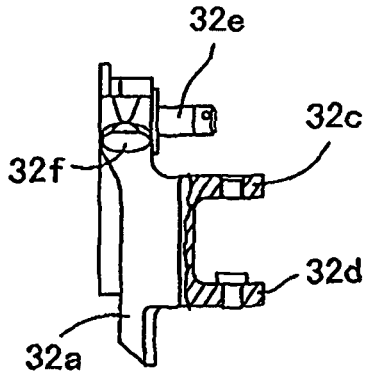
FIG. 12 is a detail view taken in the direction of arrows XII-XII of FIG. 9.

As shown in FIGS. 8 and 9, a lock member 32*f* is arranged extending in a radial direction from the disk-shaped base member 32*a*. The lock member 32*f* is located between the upper flange portion 32*c* and the pin 32*e*. A front end hole of a link member 50 is fitted on the pin 32*e*, and a retaining member 32*g* is attached to a free end of the pin 32*e*.

As shown in FIG. 8, the stopper 37 is secured on the stud 20*a* protruding leftward from the first throttle body 20 on the right side. As shown in FIGS. 5 and 8, when the first throttle valve shaft 24 is rotationally driven in a closing direction (counterclockwise direction), the lock member 32*f* of the first lever 32, which is integral with the first throttle valve shaft 24, is brought into engagement with the stopper 37 in order to prevent the first throttle valves 26 from being closed in a fully-closing direction, so that the first throttle valves 26 retain a minimum valve opening.

Figure 13:
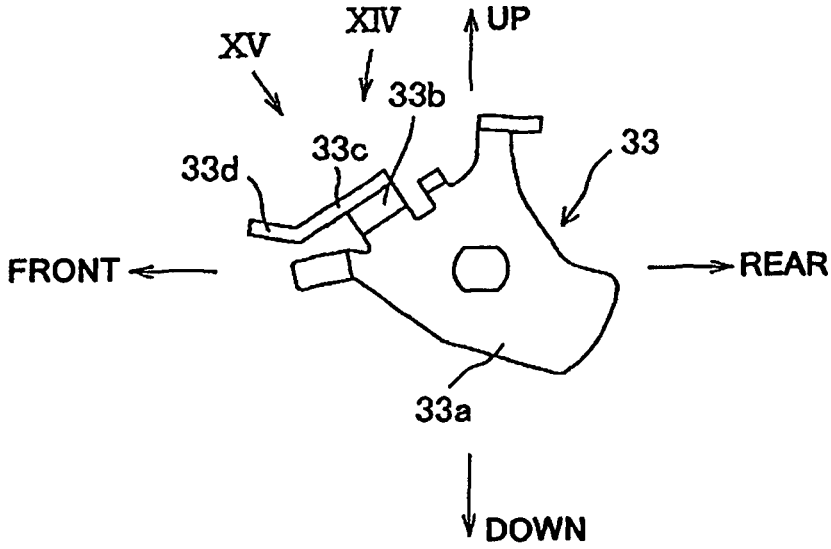
FIG. 13 is a left side view of a second lever.
Figure 14:
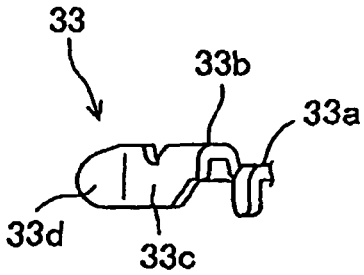
FIG. 14 is a detail view taken in the direction of arrows XIV-XIV of FIG. 13.
Figure 15:
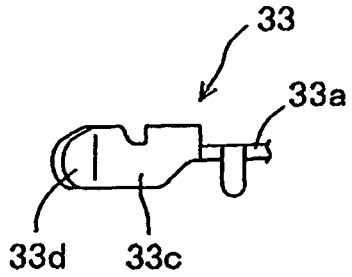
FIG. 15 is a detail view taken in the direction of arrows XV-XV of FIG. 13.

As shown in FIG. 8, and in FIGS. 13 through 15, a front receiving portion 33*c* extends from an upper front portion 33*b* of a base plate 33*a* of the second lever 33, such that the front receiving portion 33*c* is bent leftward. The front receiving portion 33*c* is provided at a front edge thereof with a contact portion 33*d* such that the contact portion 33*d* is bent upward. The contact portion 33*d* is held between a lower end of the adjustment screw 34 and an upper end of the cushion coil spring 36 secured on the upper wall of the lower flange portion 32*d* of the first lever 32. The adjustment screw 34 is threadably secured to the upper flange portion 32*c* of the first lever 32.

Figure 16:
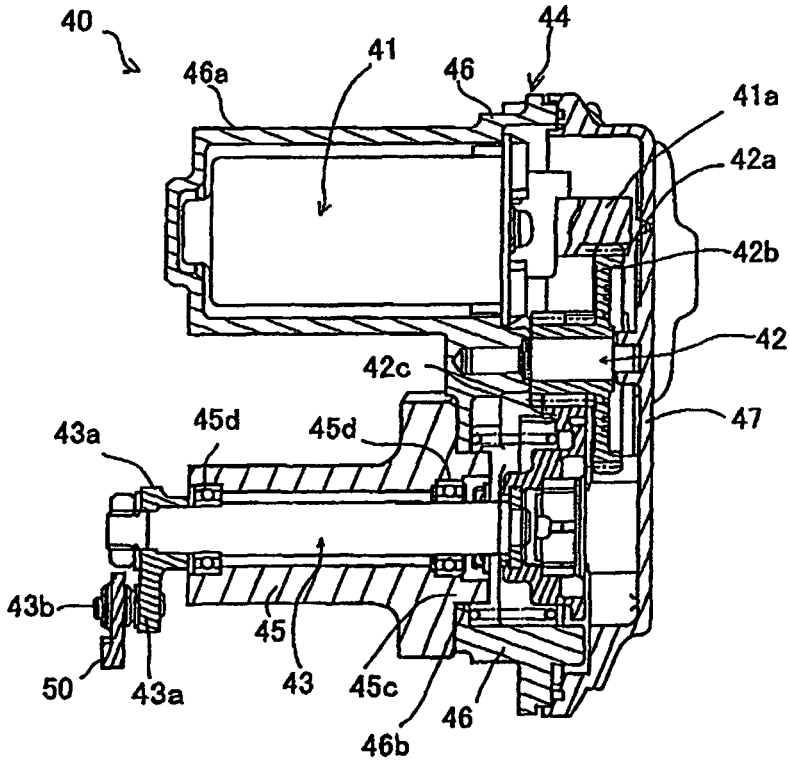
FIG. 16 is a cross-sectional view taken along line X-X of FIG. 4.

As shown in FIG. 16, the actuator 40 includes a motor 41, a reduction gear 42, an output shaft 43, and an actuator case 44. An output from the motor 41 is reduced in speed through the reduction gear 42, and is transmitted to the output shaft 43. The actuator 40 is controlled by a computer that sets the throttle valve opening based on an input by the rider's operation, a detection signal of a rotary speed of the internal combustion engine, or the like.

As shown in FIGS. 5, 8 and 16, a pin 43*b* is arranged extending from an output arm 43*a* of the output shaft 43. A rear end hole of the link member 50 is fitted on the pin 43*b* of the output arm 43*a*. A front end hole of the link member 50 is fitted on the pin 32*e* of the first lever 32.

The first lever 32 of the synchronization mechanism 31 is operated by the output shaft 43 that is rotated by an output from the motor 41 of the actuator 40 via the reduction gear 42. The first lever 32 of the synchronization mechanism 31 is rotationally driven via the link member 50 to operate (i.e., to open or close) the first throttle valves 26. The second lever 33 of the synchronization mechanism 31 is also rotationally driven to operate (i.e., open or close) the second throttle valves 27 in response to a rotational drive of the first lever 32.

Figure 18:
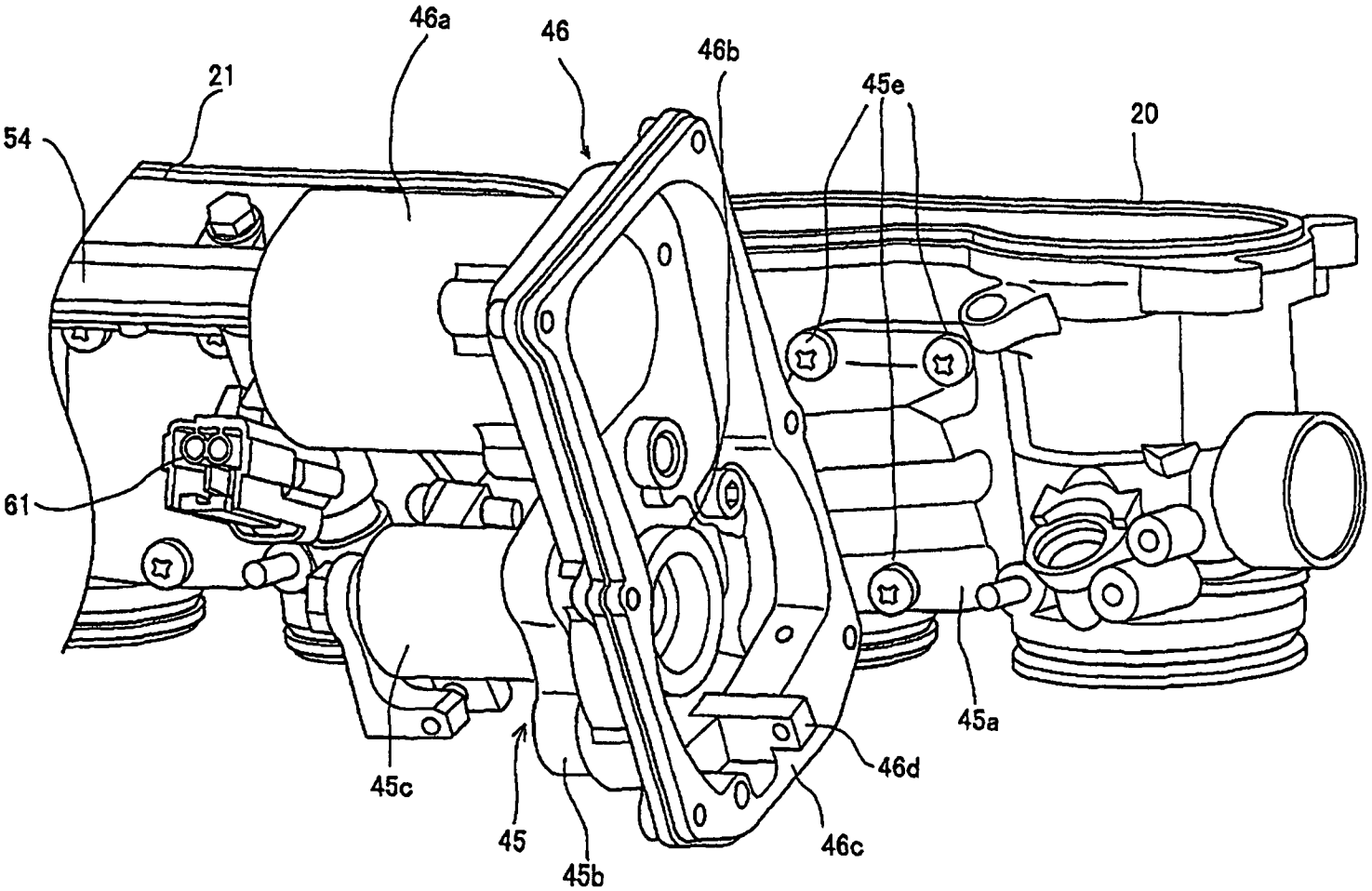
FIG. 18 is a perspective view of a motor accommodation unit secured to the output shaft journal portion as seen obliquely from a vantage point at the right rear thereof.
Figure 19:
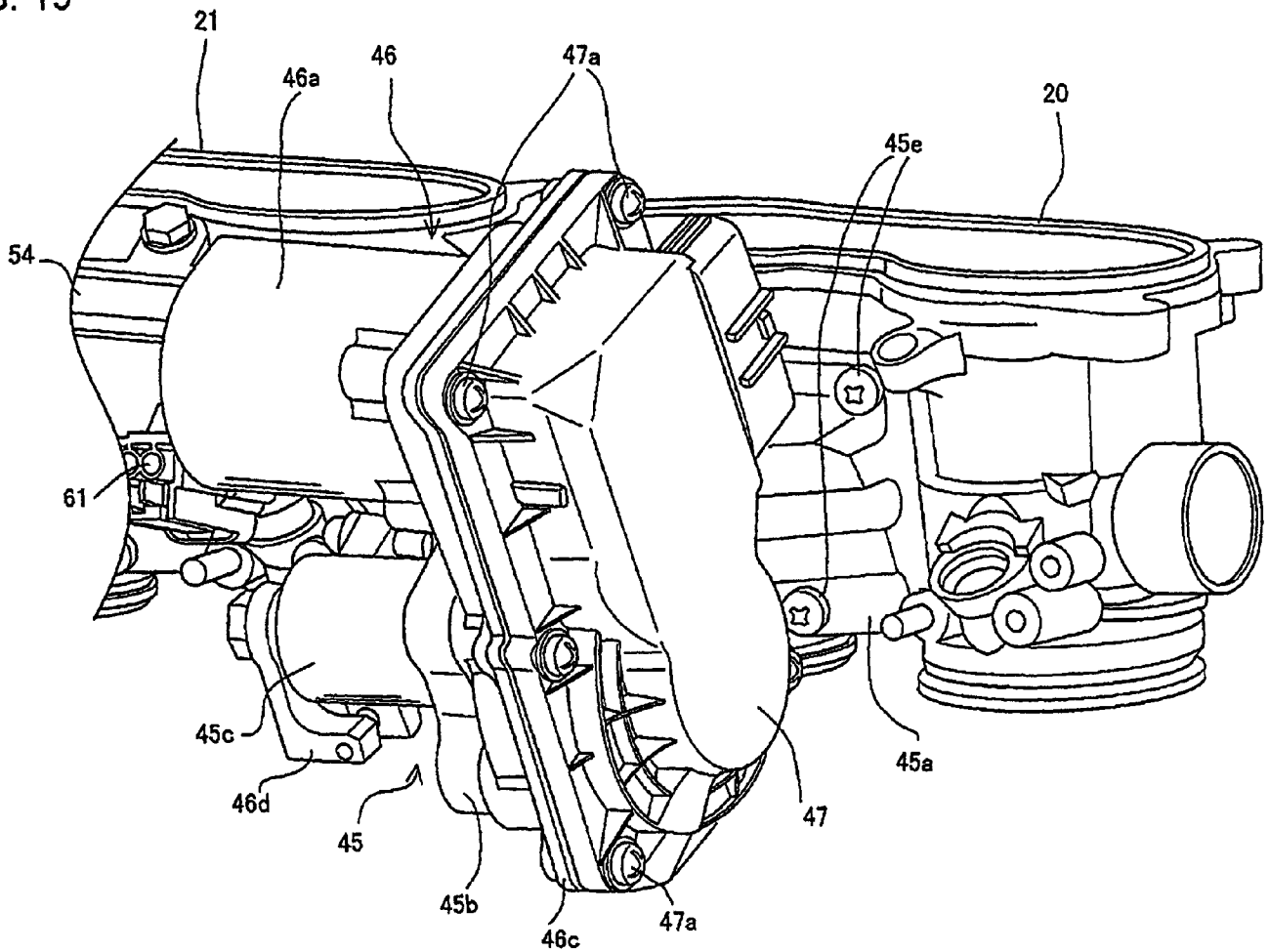
FIG. 19 is a perspective view of a cover portion secured to the motor accommodation unit as seen obliquely from a vantage point at the right rear thereof.

With reference to FIG. 16, the actuator case 44 includes an output shaft journal casing 45 (see FIGS. 3 and 17), a motor accommodation unit 46 (see FIGS. 3 and 18) and a cover member 47 (see FIGS. 3 and 19). The output shaft journal casing 45 rotatably supports the output shaft 43 thereon, and is mounted on a rear wall of the first throttle body 20 on the right hand.

The motor accommodation unit 46 is detachably secured to the output shaft journal casing 45. The motor accommodation unit 46 is configured to accommodate the motor 41 therein. The motor accommodation unit 46 rotatably supports thereon an end shaft portion of an intermediate gear 42*b* of the reduction gear 42.

The cover member 47 rotatably supports an opposite end shaft portion of the intermediate gear 42*b* of the reduction gear 42 thereon, and is detachably secured to an open end portion of the motor accommodation unit 46.

As will be described below, the actuator 40 is detachably mounted on the first throttle body 20 on the right hand such that a rotating shaft 41*a* of the motor 41 and the output shaft 43 extend in parallel with the first throttle valve shaft 24.

The output shaft journal portion 45 of the actuator case 44 includes a base portion 45*a* (see FIGS. 3 and 17), a bracket 45*b* extending rearward from a left edge of the base portion 45*a*, a support cylinder 45*c* extending leftward from a rear end of the bracket 45*b* and in parallel with the first throttle valve shaft 24, and bearings 45*d* rotatably supporting thereon opposite end portions of the output shaft 43 within the support cylinder 45*c* (see FIG. 16).

Figure 17:
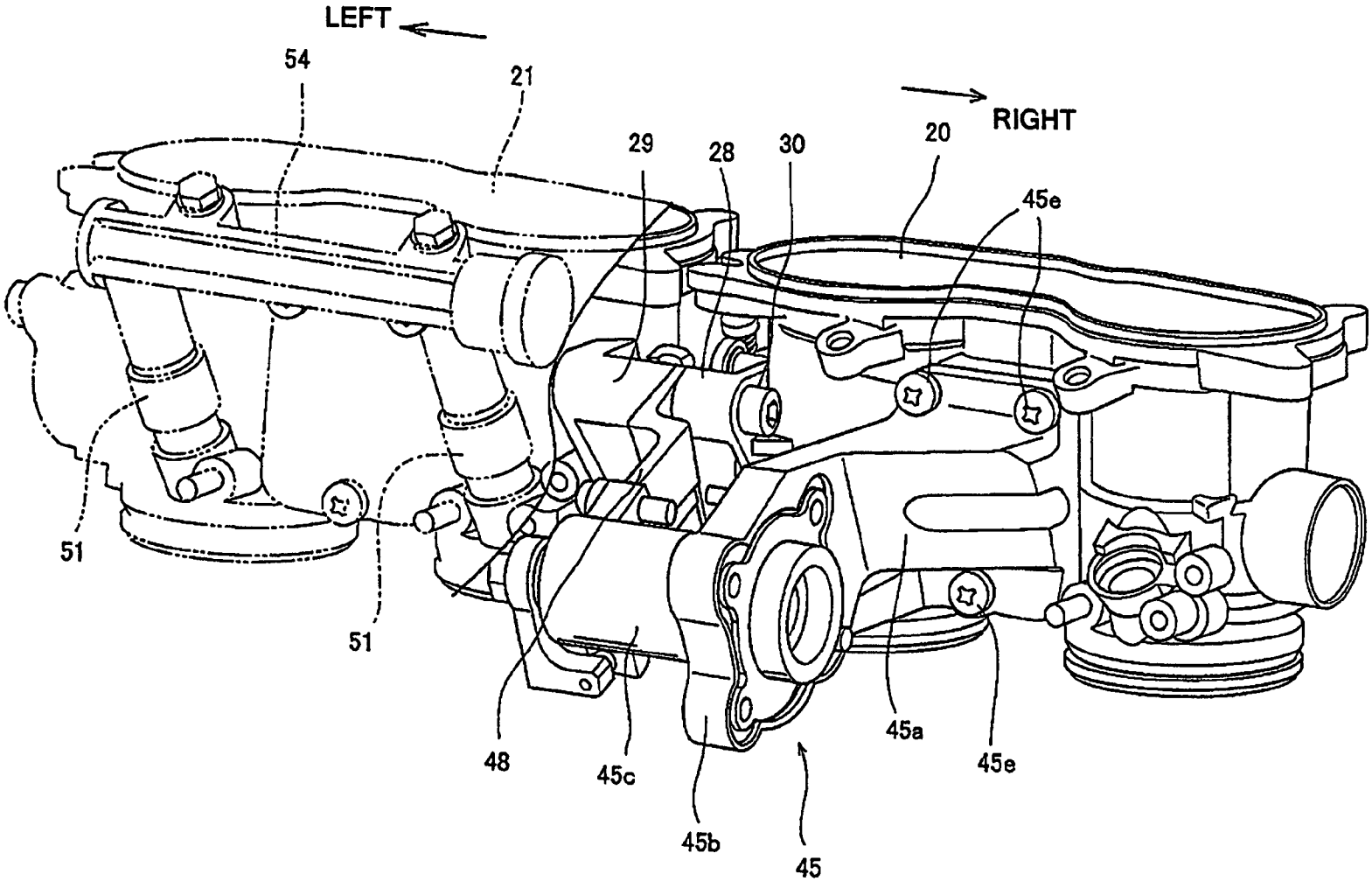
FIG. 17 is a perspective view of an output shaft journal portion of an actuator secured to a first throttle body and second throttle body as seen obliquely from a vantage point at the right rear thereof.

The output shaft journal portion 45 is integrally mounted on the rear wall of the first throttle body 20 by three screws 45*e* such that, as shown in FIG. 17, the base portion 45*a* of the output shaft journal portion 45 is in close contact with the rear wall of the first throttle body 20 at a front end face thereof. The rear wall of the first throttle body 20 extends in parallel with a plane that passes through centerlines of the two first intake passages 22 in the first throttle body 20 on the right side. The screws 45*e* extend forward through the base portion 45*a*, and are threadably secured on the first throttle body 20.

Two of the three screws 45*e* extend through an upper portion of the base portion 45*a* of the output shaft journal portion 45, and are threadably secured on the first throttle body 20. The remaining one screw 45*e* is located below the middle of the horizontal interval between the two screws 45*e*, extends through a lower portion of the base portion 45*a* of the output shaft journal portion 45, and is threadably secured on the first throttle body 20. Accordingly, the actuator 40 is firmly supported on the first throttle body 20 by the two screws 45*e* against a moment applied in such a direction that the actuator 40 would otherwise be caused to tilt downward under the weight of the actuator 40 inclined obliquely rearward and upward.

As shown in FIG. 18, a cylindrical portion 46*a* in which the motor 41 is accommodated is formed in an upper portion of the motor accommodation unit 46. A fitting portion 46*b*, having an opening, which can be fitted on a right end portion of the support cylinder 45*c* of the output shaft journal portion 45 is formed in a lower portion of the motor accommodation unit 46. As shown in FIG. 19, the cover member 47 is detachably secured by screws 47*a* with an open right-end portion 46*c* of the motor accommodation unit 46 (FIG. 18).

Figure 4:
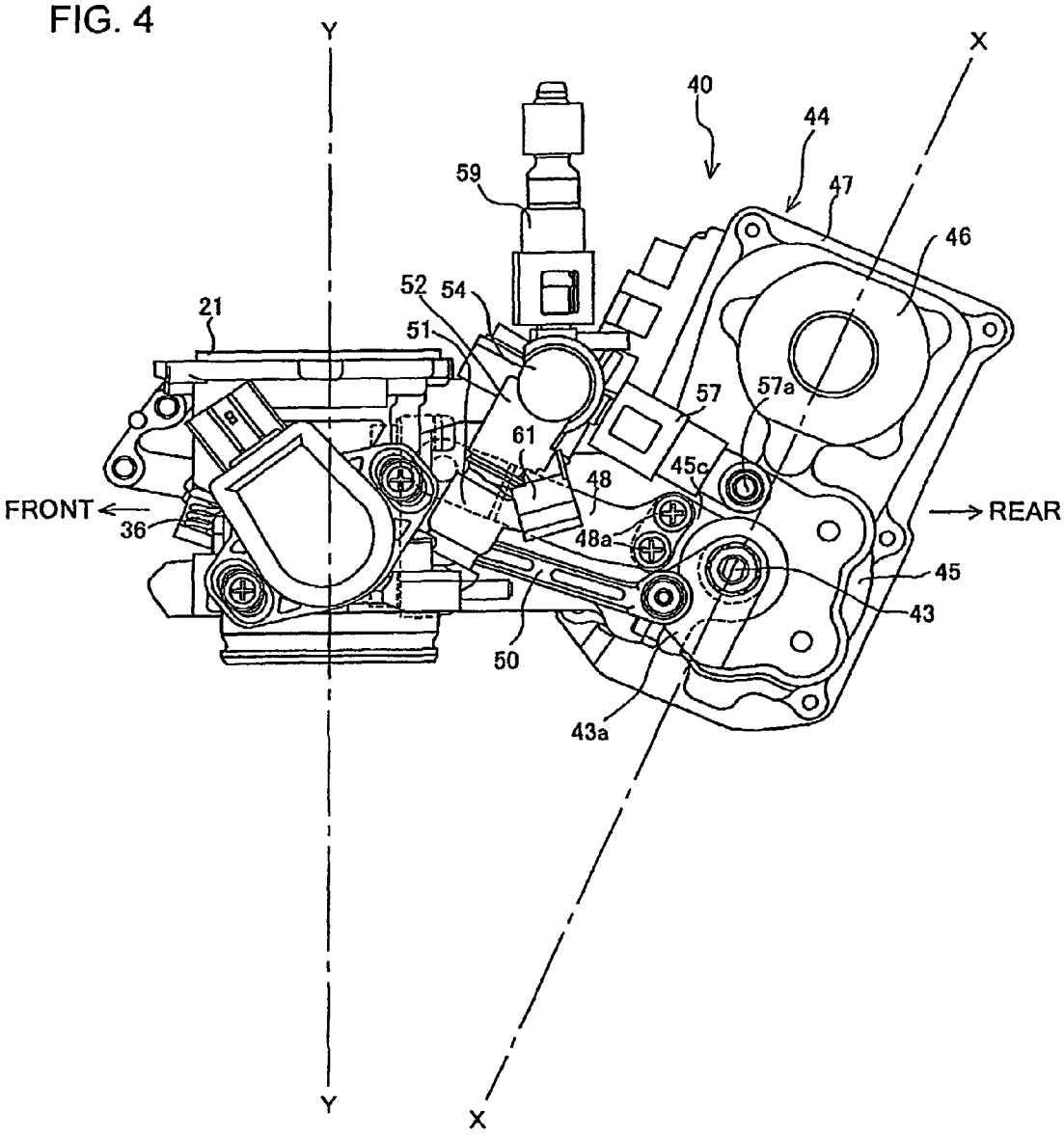
FIG. 4 is a left side view of the throttle valve control system.

As shown in FIGS. 18 and 19, the actuator 40 is mounted on the first throttle body 20 such that, as shown in FIGS. 2 and 4, the lengthwise direction of the actuator case 44 as seen in a side view, that is, the direction Z of a line which connects a centerline of the rotating shaft 41*a* of the motor 41 and a centerline of the output shaft 43 to each other is inclined obliquely from upper front toward lower rear relative to the direction Y of a centerline of the first throttle body 20.

As shown in FIG. 16, the reduction gear 42 are arranged in a space surrounded by the motor accommodation unit 46 and the cover member 47. The reduction gear 42 include a pinion 42*a*, an intermediate gear 42*b*, and an output gear 42*c*. The pinion 42*a* is arranged integrally on the rotating shaft 41*a* of the motor 41. The intermediate gear 42*b* is disposed along a plane passing through the centerline of the rotating shaft 41*a* of the motor 41 and the centerline of the output shaft 43, and is rotatably supported in parallel with the rotating shaft 41*a* of the motor 41 and the output shaft 43 between the output shaft journal portion 45 and the cover member 47.

The output gear 42*c* is arranged integrally with the output shaft 43. The intermediate gear 42*b* includes a large gear and a small gear. The large gear is maintained in meshing engagement with the pinion 41*b* arranged integrally on the rotating shaft 41*a* of the motor 41, and the smaller gear is maintained in meshing engagement with the output gear 42*c* arranged integrally with the output shaft 43 and having a larger diameter. Accordingly, the output shaft 43 has a significantly reduced speed relative to the angular velocity of the rotating shaft 41*a* of the motor 41.

Figure 6:
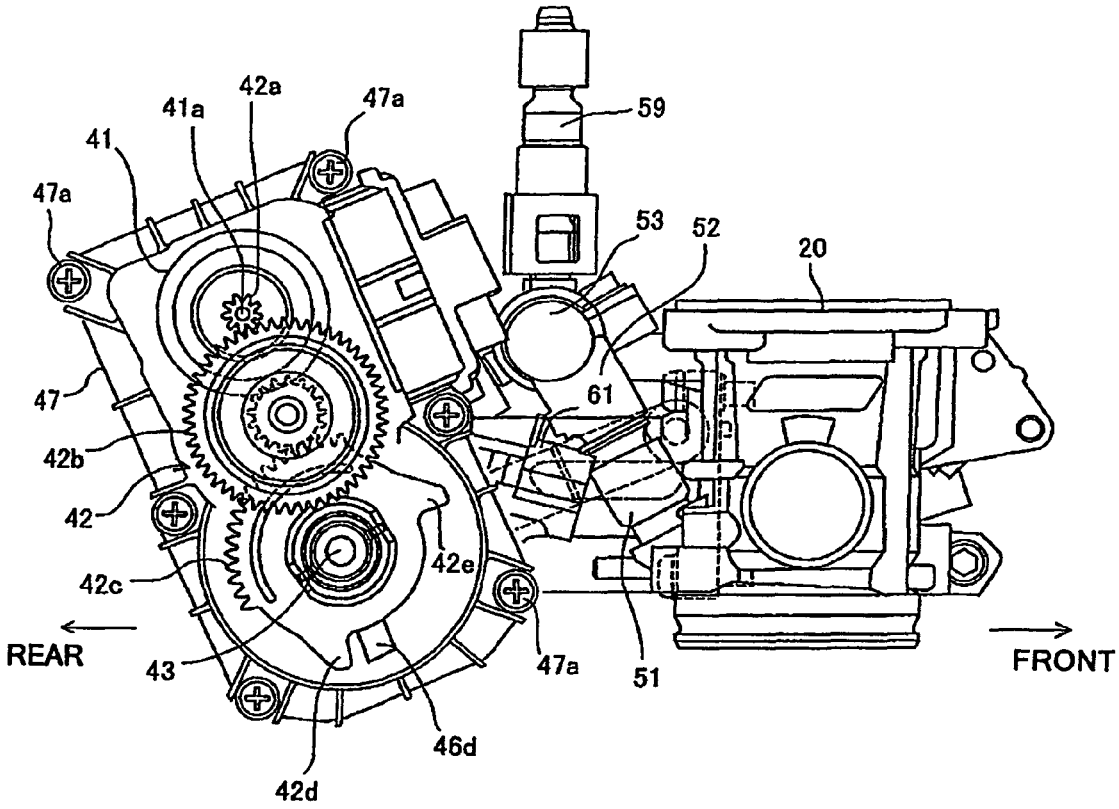
FIG. 6 is a detail view taken in the direction of arrows VI-VI of FIG. 3.

As shown in FIG. 6, the output shaft 42*c* is a segmented gear having a central angle of 120° or so. The output shaft 42*c* has an un-toothed peripheral portion having engagement tabs 42*d*, 42*e* formed at locations remote from each other with a central angle of 110° or so. As shown in FIG. 18, a stopper 46*d* is arranged on a lower portion of the open right-end portion 46*c* of the motor accommodation unit 46. Two screws (not shown) are threadably secured on the stopper 46*d* such that the screws are retractable relative to the engagement tabs 42*d*, 42*e* of the output gear 42*c*. Accordingly, the rotatable range of the output gear 42*c* is defined by the engagement tabs 42*d*, 42*e* and the stopper 46*d*, is adjustable by the two screws.

As shown in FIG. 5, the rear end hole (not shown) of the link member 50 is fitted for relative rotation on the pin 43*b* arranged extending from the output arm 43*a* of the output shaft 43 in the actuator 40. A reinforcement tie member 48 is held at a rear end portion thereof by a retaining member (not shown) such that a rear end thereof is prevented from being detached from the pin 43*b*. Further, the front end hole (not shown) of the link member 50 is fitted for relative rotation on the pin 32*e* of the first lever 32 in the synchronization mechanism 31. The link member 50 is held by the retaining member 32*g* such that a front end thereof is prevented from being detached from the pin 32*e*.

As shown in FIG. 5, the pin 43*b* on the output shaft 43 in the actuator 40 is located downward of a plane that connects a centerline of the first throttle valve shaft 24 and the centerline of the output shaft 43 in the actuator 40 to each other. The pin 32*e* on the first lever 32 arranged integrally with the first throttle valve shaft 24 is located above the same plane. During operation, when the output shaft 43 is rotated counterclockwise by an operation of the actuator 40, the first lever 32 and first throttle valve shaft 24 are rotationally driven clockwise so that the valve opening of the first throttle valves 26 increases.

As shown in FIG. 5, two screws 48*a* extend through the rear end portion of the reinforcement tie member 48 at upper and lower two locations, respectively, for threadably securing the rear end portion of the reinforcement tie member 48 on an end portion of the support cylinder 45*c* of the output shaft journal portion 45 of the actuator 40. As shown in FIG. 3, a short cylindrical portion 49*a* of a flanged short-cylindrical receiving portion 49 is fitted in an opening of a front end portion of the reinforcement tie member 48. The short cylindrical portion 49*a* is also fitted in a bore of the rear connecting boss portion 28 of the first throttle body 20. The bolt 30 extends through the connecting boss portion 28 and the flanged short-cylindrical receiving portion 49. The bolt 30 is threadably secured to the rear connecting boss portion 29 of the second throttle body 21.

As shown in FIG. 17. A right end portion of the actuator 40 is supported on the first throttle body 20 by the screws 45*e* extending through a right portion of the base portion 45*a* of the output shaft journal portion 45. The screws 45*e* are threadably secured on the rear wall of the first throttle body 20. A left end portion of the actuator 40 is supported on the first throttle body 20 and second throttle body 21 by the reinforcement tie member 48 connecting the first throttle body 20, the second throttle body 21 and the support cylinder 45*c* of the output shaft journal portion 45 to each other. As a result, the support of the right end portion of the actuator 40 by the screws 45*e* and the support of the left end portion of the actuator 40 by the reinforcement tie member 48, i.e., the support of the actuator 40 at its opposite end portions, the actuator 40 is stably and firmly connected to the first throttle body 20 and second throttle body 21.

A bottom wall of a fuel tank 17 is located above the internal combustion engine 10 and is supported on the motorcycle 1. The bottom wall of a fuel tank 17 is formed in the shape of a downwardly-opening horseshoe, when viewed in transverse section. As shown in FIG. 2, the fuel tank 17 is arranged such that the actuator 40 is accommodated in a recessed portion in a front portion of the bottom wall of the fuel tank 17. A fuel pump 18 is arranged within the fuel tank 17. The fuel pump 18 is located in back of the actuator 40.

As shown in FIGS. 2 through 4, four throttle fuel injection valves 51 are attached to the first throttle body 20 and second throttle body 21 such that they are oriented obliquely from upper rear toward lower front substantially in parallel with the vertical lengthwise direction of the actuator 40. The four throttle fuel injection valves 51 extend through the rear walls of the first throttle body 20 and second throttle body 21. The four throttle fuel injection valves 51 are connected to the two first intake passages 22 and two second intake passages 23, respectively. The four fuel throttle injection valves 51 are hence arranged to inject fuel toward the downstream sides of the first throttle valves 26 and second throttle valves 27 in the first intake passages 22 and second intake passages 23.

As shown in FIGS. 2 through 6, a first fuel line 53 and second fuel line 54 are integrally attached to the first throttle body 20 and second throttle body 21, respectively, by bolts 55 (see FIGS. 3 and 7) such that the first and second fuel lines 53, 54 extend in parallel with the first throttle valve shaft 24 and second throttle valve shaft 25 and are located substantially centrally of a front-to-rear width between the upper end portions of the first throttle body 20 and second throttle body 21 and the upper portion of the actuator 40.

A left end of the first fuel line 53 and a right end of the second fuel line 54 are connected to each other by a tubing coupler 56. The four throttle fuel injection valves 51 are connected, as combinations of two throttle fuel injection valves, to the first fuel line 53 and second fuel line 54 via connector pipes 52, respectively. A fuel-connecting member 57 is connected extending obliquely downward and rearward from the tubing coupler 56. A receiving free-end opening 57*a* (see FIGS. 2 and 3), which extends out leftward from the fuel-connecting member 57, is connected to the fuel pump 18 in the fuel tank 17 via a fuel feed line 58.

Further, couplers 61, which receive fuel injection signals, are arranged extending at right angles with the respective throttle fuel injection valves 51, and these couplers 61 are oriented toward an intermediate plane between the motor 41 of the actuator 40 and the output shaft 43.

In addition, an air chamber fuel line 59 is arranged extending upwardly from an upper portion of the tubing coupler 56. The air chamber fuel line 59 is connected to a fuel injection valve (not shown) via a fuel supply tube 60 (see FIG. 2) such that fuel can be injected into the air cleaner housing 16 via the fuel injection valve.

Advantages of the illustrative the embodiment as disclosed in FIGS. 1 through 19 are described below.

When the rotating shaft 41*a* of the motor 41 in the actuator 40 is rotated counterclockwise (see FIGS. 2, 4 and 5) by a control signal from a computer (not shown) in a state that the first throttle valves 26 and second throttle valves 27 are operated to their fully closed positions, the output shaft 43 and output arm 43*a* are also rotationally driven in the same direction via the reduction gear 42.

Then, as shown in FIG. 5, the link member 50 is pulled toward the rear of the motorcycle 1 so that the first throttle valve shaft 24 is rotationally driven clockwise together with the first lever 32, and the second throttle valve shaft 25 via the synchronization mechanism 31. Accordingly, the first throttle valves 26 and second throttle valves 27 are rotationally driven in the same direction, and respective openings thereof openings increase.

When the motor 41 of the actuator 40 is rotated in the reverse direction, that is, in a clockwise direction, on the other hand, operations opposite to those mentioned above are performed so that the first throttle valves 26 and second throttle valves 27 are rotationally driven in the closing direction.

In the internal combustion engine 10, the first throttle body 20 and second throttle body 21 are integrally connected to each other by the bolts 30 threadably secured to the front and rear second connecting boss portions 29 through the corresponding first connecting boss portions 28 such that the first throttle valve shaft 24 and second throttle valve shaft 25 in the first throttle body 20 and second throttle body 21 on the right and left sides are aligned on and along the straight line, and the first throttle valve shaft 24, second throttle valve shaft 25, the first throttle valves 26 and second throttle valves 27 are rotationally driven by the actuator 40. Similar to an internal combustion engine in which plural throttle valves are all rotationally driven by a single throttle valve shaft, the first throttle valves 26 and second throttle valves 27 are, therefore, smoothly operated (opened or closed) in unison by the actuator 40.

The first throttle valve shaft 24 and second throttle valve shaft 25 are connected to each other via the synchronization mechanism 31. The output shaft 43 of the actuator 40 is connected via the link member 50 to the first lever 32 of the synchronization mechanism 31. The first lever 32 is connected to the left end portion of the first throttle valve shaft 24. The first lever 32 integral with the left end portion of the first throttle valve shaft 24, and the second lever 33 integral with the right end portion of the second throttle valve shaft 25 are connected together. Accordingly, the valve drive structure, which includes the actuator 40 and the interposed link member 50, and the synchronization mechanism 31 are arranged without taking much space between the opposite ends of the first throttle valve shaft 24 and second throttle valve shaft 25. Accordingly, the throttle valve control system 11 can be reduced in size. More significantly, the throttle valve control system 11 can be shortened in its dimension in the lateral direction of the motorcycle body.

The primary components of the synchronization mechanism 31 include the first lever 32 secured to the left end portion of the first throttle valve shaft 24, and the second lever 33 secured to the right end portion of the second throttle valve shaft 25. Accordingly, the arrangement of the link member 50 by utilization of the space between the first lever 32 and the second lever 33 combined together as left and right levers in the synchronization mechanism 31 can obviate a space which would otherwise be needed for the arrangement of the link member 50, and can avoid an increase in the size of the throttle valve control system 11.

The first throttle valve shaft 24 and second throttle valve shaft 25 located in the front portion and the output shaft 43 of the actuator 40 located in the rear portion are arranged in parallel with each other. Moreover, the front end portion of the link member 50, which is connected at the left end of the first throttle valve shaft 24 to the pin 32*e* of the first lever 32 in the synchronization mechanism 31, and the rear end portion of the link member 50, which is connected to the pin 43*b* at the output shaft 43 in the actuator 40, are arranged up and down with the plane, which passes through the centerline of the first throttle valve shaft 24 and second throttle valve shaft 25. The centerline of the output shaft 43 in the actuator 40 is located between the front and rear end portions. Accordingly, the link member 50 can be arranged by utilizing the empty space between the first throttle valve shaft 24 and the output shaft 43 of the actuator 40. This makes it possible to efficiently arrange the link member 50 without its protrusion.

Further, the connected portion between the first lever 32 and the second lever 33 in the synchronization mechanism 31—specifically, the connected portions of the upper flange portion 32*c* and lower flange portion 32*d* of the first lever 32, the adjustment screw 34, the cushion coil spring 36 and the contact portion 33*d* of the second lever 33, all of which are located forward of the first throttle valve shaft 24—are arranged forward on the side opposite to the actuator 40 with the first throttle valve shaft 24 interposed therebetween. The link member 50 is arranged between the first lever 32 and the second lever 33 in the synchronization mechanism 31. The pin 32*e* which connects the first lever 32 and the link member 50 together is arranged in back of the connected portion between the first lever 32 and the second lever 33.

Accordingly, interference can be avoided between the synchronization mechanism 31 and the link member 50, and the throttle valve control system 11 can be constructed into a compact structure.

The throttle valve control system 11 is equipped with the throttle fuel injection valves 51 and the fuel-connecting member 57 for supplying fuel to the throttle fuel injection valves 51, and the fuel-connecting member 57 is arranged along the link member 50. Accordingly, interference can be avoided between the link member 50 and the fuel-connecting member 57, and the throttle valve control system 11 can be constructed into a compact structure.

Moreover, the synchronization mechanism 31 is provided with the cushion coil spring 36, interposed between the lower flange portion 32*d* of the first lever 32 and the contact portion 33*d* of the second lever 33. Accordingly, the valve openings of the first throttle valve shaft 24 and the second throttle valve shaft 25, arranged on the right and left sides, respectively, can be precisely and readily adjusted by simply turning the adjustment screw 34 in a desired direction, in order to adjust the interval between the lower flange portion 32*d* of the first lever 32 and the contact portion 33*d* of the second lever 33.

The first throttle body 20 is provided with the two throttle fuel injection valves 51, and the first fuel line 53 for connecting the throttle fuel injection valves 51 to the fuel pump 18 is arranged in parallel with the first throttle valve shaft 24 and between the first throttle body 20 and the actuator 40.

Accordingly, no restriction is imposed on the arrangement of the first fuel line 53 by the existence of the actuator 40, and the throttle fuel injection valves 51 can be arranged at appropriate positions relative to the first throttle body 20. Accordingly, it is possible to avoid a reduction in the performance of the internal combustion engine 10 and also to avoid a detour of the first fuel line 53 and hence to shorten the tubing.

The actuator 40 includes the motor 41, the reduction gear 42, the output shaft 43 and the actuator case 44. The rotational shaft (axis) of these motor 41, reduction gear 42 and output shaft 43 are arranged on a plane, and the actuator 40 is vertically long (FIG. 19). The actuator 40 is arranged with the plane Z, which passes through the plural rotational axes in the actuator 40, being inclined rearward about its lower end relative to the second throttle body 21 and first intake passages 22, as shown in FIG. 2. The first fuel line 53 is arranged at the high position in the wide space between the first throttle body 20 and the actuator case 44.

Accordingly, the first throttle body 20, actuator case 44, throttle fuel injection valves 51 and first fuel line 53 can be arranged together into a compact structure, and accessories needed for the internal combustion engine 10 can be disposed in a space in back of the second throttle body 21. Therefore, it is possible to achieve an overall size reduction of the internal combustion engine 10.

As shown in FIG. 2, the throttle fuel injection valves 51 are oriented substantially in parallel with the plane Z that passes through the plural rotational axes in the actuator 40. Accordingly, it is possible to achieve a size reduction of the throttle valve control system 11 constructed of the first throttle body 20 and the actuator 40 and also size reductions of the connector pipes 52, tubing coupler 56 and fuel connection member 57 in the fuel supply system.

As also shown in FIG. 2, the throttle fuel injection valves 51 are arranged adjacent the actuator case 44 located close to the first throttle body 20 in the actuator 40 arranged tilted relative to the first throttle body 20.

Accordingly, interference can be avoided between the throttle fuel injection valves 51 and the actuator 40, and the throttle fuel injection valves 51 can be assembled in the throttle valve control system 11 without taking much space.

The first fuel line 53 and second fuel line 54 are arranged in the vicinity of the plane extending through the intake upstream ends of the first throttle body 20 and second throttle body 21 and intersecting at right angles with the direction Y of intake through the first throttle body 20 and second throttle body 21.

Accordingly, the first fuel line 53 and second fuel line 54 can be arranged at lower positions in the wide space between the first throttle body 20 and second throttle body 21 and the actuator case 44. It is, therefore, possible to shorten the dimension in the direction of the height of the throttle valve control system 11.

As also shown in FIG. 2, the couplers 61 disposed to supply electric inputs to the throttle fuel injection valves 51 are arranged oriented toward between the motor 41 and the output shaft 43 in the actuator 40. Accordingly, a harnesses (not shown) connected to the couplers 61 can be arranged between the motor 41 and the output shaft 43 without detouring the actuator 40, thereby permitting their efficient and easy arrangement.

With reference to the division of the throttle body into the first throttle body 20 and second throttle body 21, the fuel line is also divided into the first fuel line 53 and second fuel line 54. The first fuel line 53 and second fuel line 54 are connected together by the tubing coupler 56. Therefore, upon replacement of one of the four throttle fuel injection valves 51, it is only necessary to disconnect only the fuel line associated with the one throttle fuel injection valve 1. The throttle valve control system 11, therefore, facilitates easy maintenance and repair work.

The actuator case 44 in the actuator 40 is formed as a discrete member from the first throttle body 20 and second throttle body 21. The actuator case 44 is detachably secured by the screws 45*e* in contact with the rear wall of the first throttle body 20 which is substantially in parallel with the plane passing through the first throttle valve shaft 24 and the first intake passages 22.

Accordingly, the actuator case 44 is prevented from protruding toward the first throttle valve shaft 24 of the first throttle body 20, and therefore, the actuator case 44 can be reduced in size. Further, the actuator 40 can be easily conditioned or repaired by simply detaching the actuator 40 alone from the first throttle body 20 without disassembling the first throttle body 20 from the cylinder head 14 of the internal combustion engine 10.

The actuator case 44 is secured to the first throttle body 20 by the screws 45*e* oriented in the direction intersecting at right angles with the plane of mutual contact between the first throttle body 20 and the actuator case 44. Accordingly, the actuator case 44 can be prevented from moving upward, rearward, leftward or rightward relative to the first throttle body 20 along the plane of contact between the first throttle body 20 and the actuator case 44 so that the actuator case 44 can be surely secured in an accurate positional relation to the first throttle body 20.

Figure 7:
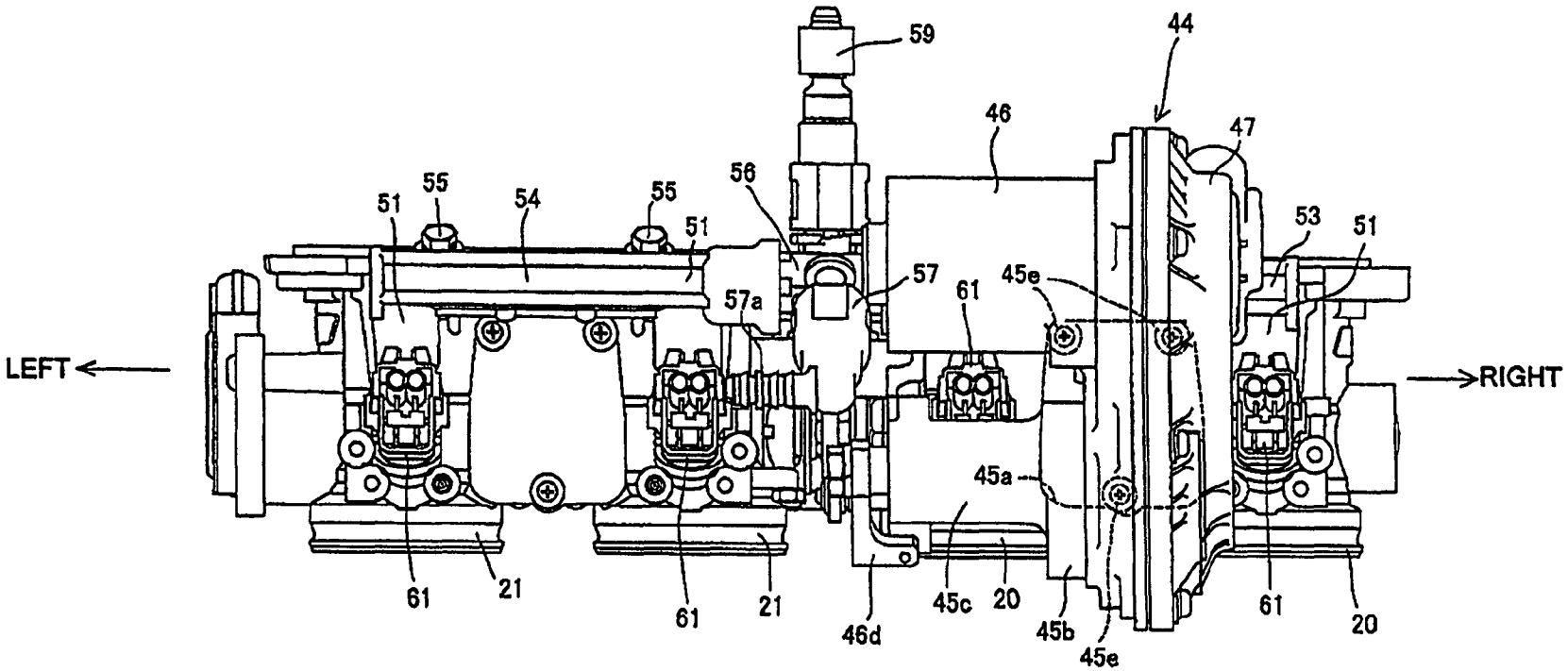
FIG. 7 is a detail view taken in the direction of arrows VII-VII of FIG. 3.

The screws 45*e* are arranged up and down with the plane, which passes through the centerline of the first throttle valve shaft 24 and intersects at right angles with the plane of contact between the first throttle body 20 and the actuator case 44, being located therebetween (see FIGS. 7 and 17). Even when the actuator case 44 receives reaction force as a result of an operation of the actuator 40 for the first throttle body 20, the actuator case 44 can, therefore, remain firmly and stably fixed against the reaction force.

As shown in FIGS. 3 and 17, the actuator case 44 is arranged between the opposite ends of the first throttle valve shaft 24 in the first throttle body 20 on which the actuator case 44 is secured. Accordingly, the actuator case 44 does not protrude leftward or rightward to the outside beyond the corresponding one of the opposite ends of the first throttle valve shaft 24 in the first throttle body 20, thereby making it possible to achieve a reduction in the size of the throttle valve control system 11.

In the throttle valve control system 11 for the internal combustion engine 10 that the first throttle body 20 and second throttle body 21, which form the first intake passages 22 and second intake passages 23, respectively, are arrayed along the first throttle valve shaft 24 and second throttle valve shaft 25 and the first throttle valves 26 and second throttle valves 27 are operated by an output from the actuator 40 via the first throttle valve shaft 24 and second throttle valve shaft 25. The actuator 40 is connected to the first throttle body 20 via the reinforcement tie member 48. As a torque transmitting member for transmitting a throttle torque from the output shaft 43 of the actuator 40 to the first throttle valve shaft 24, the link member 50 is arranged on the side of arrangement of the reinforcement tie member 48, as shown in FIG. 3. By avoiding with the reinforcement tie member 48 a positional displacement which would otherwise takes place due to an assembling error between the actuator 40 and the link member 50, mass productivity can, therefore, be improved while maintaining the assembling accuracy at high level.

As shown in FIGS. 3 and 5, the reinforcement tie member 48 via which the actuator 40 and the first throttle body 20 are connected to each other is arranged close to the link member 50 that transmits a throttle-valve opening torque from the output shaft 43 of the actuator 40 to the first throttle valve shaft 24. Therefore it is possible to reduce an assembling error around the position where the link member 50 is arranged, so that the first throttle valves 26 and second throttle valves 27 can be open/close driven with good accuracy.

As also shown in FIGS. 3 and 5, the link member 50 via which the output shaft 43 of the actuator 40 and the first throttle valve shaft 24 are connected to each other is arranged along the reinforcement tie member 48. Therefore it is possible to avoid interference between the reinforcement tie member 48 and the link member 50, so that a dead space in the neighborhood of these members is reduced to permit a reduction in the size of the throttle valve control system 11.

The reinforcement tie member 48 is formed in the shape of a plate, and is held between the first connecting boss portions 28 of the first throttle body 20 and the connecting boss portion 29 of the second throttle body 21. The reinforcement tie member 48 is firmly secured on the first throttle body 20 and second throttle body 21 by the bolt 30 threadably secured to the connecting boss portion 29 through the connecting boss portion 28 and the reinforcement tie member 48.

The internal combustion engine 10 is equipped with the throttle valve control system 11 which drives the first throttle valves 26 and second throttle valves 27 by the actuator 40. The first throttle body 20 and second throttle body 21 with the first throttle valves 26 and second throttle valves 27 built therein are arranged on the rear wall of the cylinder head 14 tilted toward the front of the motorcycle 1. The air cleaner housing 16 is arranged forward of the first throttle body 20 and second throttle body 21. Accordingly, the first throttle body 20 and second throttle body 21 are protected by the cylinder head 14 and air cleaner housing 16.

As shown in FIG. 2, the actuator 40 constructed in the form of a rectangle, when viewed in a side view, is arranged in the region located in back of the first throttle body 20 and second throttle body 21 and above the crankcase 12 oriented toward the rear of the motorcycle body. In the region defined by the rear walls of the first throttle body 20 and second throttle body 21 and the top wall of the crankcase 12 and having an included angle $\alpha$, the direction Z of the length of the actuator 40 is oriented in a direction that an angle $\beta$ formed between the direction Z of the length of the actuator 40 and the rear wall of the first throttle body 20.

In other words, the angle $\beta$ formed between the direction Z of the length of the actuator 40 and the centerline Y of the first intake passages 22 is close to approximately a half of the included angle $\alpha$. Accordingly, by making effective use of the region having the included angle α, the actuator 40 can be arranged on the cylinder head 14, thereby permitting a reduction in the size of the internal combustion engine 10.

The rotating shaft 41*a* of the motor 41, the rotational axis of the reduction gear 42 and the output shaft 43 in the actuator 40 are oriented in directions parallel with the first throttle valve shaft 24. Accordingly, the actuator 40 can be positioned still closer to the side of the first throttle body 20, thereby permitting a further reduction in the size of the internal combustion engine 10.

As shown in FIG. 3, the internal combustion engine 10 is a four-cylinder internal combustion engine, the two throttle bodies that form the first intake passages 22 and second intake passages 23, that is, the first throttle body 20 and second throttle body 21 are arranged in parallel with the first throttle valve shaft 24 and second throttle valve shaft 25, and the actuator 40 is arranged within the horizontal width of the first throttle body 20.

Accordingly, the actuator 40 does not protrude rightward from the internal combustion engine 10, the widthwise dimension of the internal combustion engine 10 is shortened, and moreover, the actuator 40 does not protrude in back of the second throttle body 21. Therefore, other accessories for the internal combustion engine 10 can be arranged in back of the second throttle body 21, and the size reduction of the internal combustion engine 10 can be promoted further.

As shown in FIG. 2, the fuel tank 17 is arranged in back of the first throttle body 20 and above the crankcase 12, and the actuator 40 is arranged in the region surrounded by the first throttle body 20, crankcase 12 and fuel tank 17. Accordingly, this region can be effectively utilized as a space for arranging the actuator 40, and moreover, a further size reduction of the internal combustion engine 10 and protection of the actuator 40 are feasible.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A throttle valve control system for an internal combustion engine, said internal combustion engine comprising:

plural throttle bodies, each of said throttle bodies having respective intake passages formed therethrough, wherein said throttle bodies are each provided with plural fuel injection valves, and fuel lines which connect their corresponding fuel injection valves together;

first and second throttle valve shafts, with one of said shafts operatively associated with each of said throttle bodies;

first and second throttle valves operatively connected with said first and second throttle valve shafts, respectively;

wherein said throttle valve control system comprises an actuator for operating said throttle valves via said throttle valve shafts, and a synchronizer mechanism which interconnects said first and second throttle valve shafts, said synchronizer mechanism comprising first and second levers operatively connected to said first and second throttle valve shafts, respectively, and an adjuster for adjusting the position of the second lever in relation to the first lever;

wherein said fuel injection valves and a plurality of fuel lines connecting adjacent fuel injection valves together are arrayed in parallel with a direction of said throttle valve shafts;

and wherein said fuel injection valves and said fuel lines are arranged between said throttle bodies and said actuator.

2. The throttle valve control system of claim 1, wherein:

said actuator comprises a motor, a reduction gear, an output shaft, and an actuator case;

respective rotational axes of the motor, the reduction gear and the output shaft are arranged parallel with each other, and along a plane such that said actuator is constructed in a substantially flattened form;

and the actuator is arranged such that a plane, which extends through said axes of said motor, reduction gear and output shaft, is inclined relative to said intake passages, and wherein said fuel lines are arranged between said throttle bodies and said actuator case.

3. The throttle valve control system of claim 2, wherein said fuel injection valves are oriented substantially parallel to said plane which extends through said rotational axes.

4. The throttle valve control system of claim 2, wherein said fuel injection valves are arranged adjacent to a portion of said actuator case proximate said throttle bodies.

5. The throttle valve control system for an internal combustion engine of claim 3, wherein said fuel injection valves are arranged adjacent to a portion of said actuator case proximate said throttle bodies.

6. The throttle valve control system of claim 1, wherein said fuel lines are arranged in a vicinity of a plane extending through intake upstream ends of said throttle bodies and intersecting at right angles with a direction of intake through said throttle bodies.

7. The throttle valve control system of claim 2, wherein said fuel lines are arranged in a vicinity of a plane extending through intake upstream ends of said throttle bodies and intersecting at right angles with a direction of intake through said throttle bodies.

8. The throttle valve control system of claim 3, wherein said fuel lines are arranged in a vicinity of a plane extending through intake upstream ends of said throttle bodies and intersecting at right angles with a direction of intake through said throttle bodies.

9. The throttle valve control system of claim 4, wherein said fuel lines are arranged in a vicinity of a plane extending through intake upstream ends of said throttle bodies and intersecting at right angles with a direction of intake through said throttle bodies.

10. The throttle valve control system of claim 2, further comprising couplers provided with said fuel injection valves, said couplers operable to supply electric inputs to said fuel injection valves, wherein said couplers are arranged between said motor and said output shaft of said actuator, and wherein said couplers are oriented towards an intermediate plane disposed between said motor and said output shaft.

11. The throttle valve control system of claim 3, further comprising couplers provided with said fuel injection valves, said couplers operable to supply electric inputs to said fuel injection valves, wherein said couplers are arranged between said motor and said output shaft of said actuator, and wherein said couplers are oriented towards an intermediate plane disposed between said motor and said output shaft.

12. The throttle valve control system of claim 4, further comprising couplers provided with said fuel injection valves, said couplers operable to supply electric inputs to said fuel injection valves, wherein said couplers are arranged between said motor and said output shaft of said actuator, and wherein said couplers are oriented towards an intermediate plane disposed between said motor and said output shaft.

13. The throttle valve control system of claim 6, further comprising couplers provided with said fuel injection valves, said couplers operable to supply electric inputs to said fuel injection valves, wherein said couplers are arranged between said motor and said output shaft of said actuator, and wherein said couplers are oriented towards an intermediate plane disposed between said motor and said output shaft.

14. An internal combustion engine, comprising:

a first throttle body and a second throttle body, each of the throttle bodies having a respective intake passage formed therethrough, wherein said throttle bodies are each provided with plural fuel injection valves, and fuel lines which connect said fuel injection valves together;

a throttle valve shaft operatively associated with each of said throttle bodies, respectively;

a throttle valve operatively associated with each of said throttle bodies, respectively;

and a throttle valve control system comprising an actuator and a synchronization mechanism operatively connecting said throttle valve shafts together, said synchronization mechanism operatively connected with said actuator and comprising first and second levers and an adjuster for adjusting the position of the second lever in relation to the first lever;

wherein said fuel injection valves of said throttle bodies and said fuel lines connecting adjacent fuel injection valves together are arrayed in parallel with a direction of said throttle valve shafts, and wherein said fuel injection valves and said fuel lines are arranged between said throttle bodies and said actuator.

15. An internal combustion engine according to claim 14, wherein said actuator comprises wherein said actuator comprises a motor, a reduction gear, an output shaft, and an actuator case;

wherein respective rotational axes of the motor, the reduction gear and the output shaft are arranged parallel with each other, and along a plane such that said actuator is constructed in a substantially flattened form;

and wherein the actuator is arranged such that a plane, which extends through said axes of said motor, reduction gear and output shaft, is inclined relative to said intake passages, and wherein said fuel lines are arranged between said throttle bodies and said actuator case.

16. An internal combustion engine according to claim 15, wherein said fuel injection valves are oriented substantially parallel to said plane which extends through said rotational axes of the motor, the reduction gear and the output shaft of the actuator.

17. An internal combustion engine according to claim 2, wherein said fuel injection valves are arranged adjacent to a portion of said actuator case proximate said throttle bodies, and wherein said actuator is inclined relative to said throttle bodies.

18. A vehicle comprising an internal combustion engine and a throttle valve control system, said internal combustion engine comprising a first throttle body and a second throttle body, each having a respective intake passage formed therethrough, and being provided with plural fuel injection valves, and fuel lines connecting adjacent fuel injection valves together;

a pair of throttle valve shafts, wherein a throttle valve shaft is operatively associated with each of said throttle bodies, respectively; and a throttle valve operatively associated with each of said throttle bodies, respectively;

said throttle valve control system comprising an actuator for operating said throttle valves via said throttle valve shafts, and a synchronizer mechanism which interconnects said throttle valve shafts, said synchronizer mechanism comprising first and second levers and an adjuster for adjusting the position of the second lever in relation to the first lever;

wherein said fuel injection valves and said fuel lines connecting adjacent fuel injection valves together are arrayed in parallel with a direction of said throttle valve shafts, and wherein said plural fuel injection valves and said fuel lines are arranged between said throttle bodies and said actuator.

19. A vehicle according to claim 18, wherein said actuator comprises a motor, a reduction gear, an output shaft, and an actuator case;

wherein respective rotational axes of the motor, the reduction gear and the output shaft are arranged parallel with each other, and along a plane such that said actuator is constructed in a substantially flattened form;

and wherein the actuator is arranged such that a plane, which extends through said axes of said motor, reduction gear and output shaft, is inclined relative to said intake passages, and wherein said fuel lines are arranged between said throttle bodies and said actuator case.

20. A vehicle according to claim 19, wherein said fuel injection valves are oriented substantially parallel to said plane which extends through said rotational axes of the motor, the reduction gear and the output shaft of the actuator.

* * * * *